US006772748B2

(12) United States Patent
Cleary

(10) Patent No.: US 6,772,748 B2
(45) Date of Patent: Aug. 10, 2004

(54) METHOD OF FORMING STONE INLAYS IN WOOD AND ARTICLE OF MANUFACTURE

(76) Inventor: Sean Cleary, 336-B Berkshire Ave., Redwood City, CA (US) 94063

( * ) Notice: Subject to any disclaimer, the term of this patent is extended or adjusted under 35 U.S.C. 154(b) by 0 days.

(21) Appl. No.: 10/234,792

(22) Filed: Sep. 5, 2002

(65) Prior Publication Data

US 2003/0070671 A1 Apr. 17, 2003

Related U.S. Application Data

(63) Continuation-in-part of application No. 09/975,207, filed on Oct. 12, 2001.

(51) Int. Cl.[7] ..... B28D 1/00

(52) U.S. Cl. ..... 125/1; 125/30.01; 125/35; 451/28; 451/29; 451/30; 451/31; 451/41; 451/44

(58) Field of Search ..... 125/1, 30.01, 35; 451/28, 29, 30, 31, 41, 44

(56) References Cited

U.S. PATENT DOCUMENTS 3,842,488 A * 10/1974 Mitchell ..... 29/527.6
6,499,314 B1 * 12/2002 Weimann et al. ..... 63/26
6,617,005 B2 * 9/2003 Duffney ..... 428/138

* cited by examiner

*Primary Examiner*—Joseph J. Hail, III
*Assistant Examiner*—Shantese McDonald
(74) *Attorney, Agent, or Firm*—John P. Sutton

(57) ABSTRACT

A method of forming a stone inlay in an abrasion-sensitive substrate, such as wood, by forming a depression in the substrate, mounting stone on a damping material capable of absorbing the abrasive energy applied to the stone in reducing the dimensions of the stone to fit the depression, cutting the inlay to size and inserting it into the substrate. The cut inlay/damping material composite may be sold separately as an article of manufacture.

12 Claims, 1 Drawing Sheet

METHOD OF FORMING STONE INLAYS IN WOOD AND ARTICLE OF MANUFACTURE

This application is a continuation-in-part of application Ser. No. 09/975,207 filed Oct. 12, 2001.

FIELD OF THE INVENTION

Inlays of marble, granite and other stones and vitreous materials have been used in decorative arts for centuries. Normally, the inlay and the substrate are of like materials so that the surface may be polished to a degree necessary to make clear images of different colors, textures and impressions desired in the final product. For example, if the medium is wood, the substrate is generally wood and the inlays are of variously colored wood fragments. Likewise, if the inlays are stone, the substrate is usually a similar hard, brittle material that may be polished with abrasives that could not be used on wood because they would damage the wood rather than polish it.

Inlays of materials dissimilar to the substrates, as far as hardness is concerned, have been difficult to prepare because of the different polishing requirements. Stone in wood, for example, has heretofore required the inlay to be formed in precisely the dimensions of the final product, then polished to the degree desired in the final product. Where the dimension of the inlay is small, say, less than two centimeters in the shortest dimension, there is a substantial risk that the brittle stone will break or chip, making the inlay useless and requiring a new beginning. In the Middle Ages, when the cost of skilled workers and stone materials was no object, trial and error over and over was a possibility. Today, however, there is a need for a reliable method of making inlays of hard materials for insertion into substrates of soft materials.

Moreover, different trades are involved in stone work and in cabinetry. In kitchen remodeling, for example, a cabinet-maker will prepare drawers, doors and storage units for a kitchen, and a different tradesman will cut and install granite or marble counter surfaces. Making stone inlays in wood cabinets, made possible by the present invention, involves a marriage of two dissimilar trades, accounting for the fact that inlays of stone in wood are seldom attempted today.

Marble and granite have great compressive strength, but poor tensile strength. This means that it can be cut in a vertical plane but not in a horizontal plane when not supported by great mass. Thus, to make narrow strips for inlays, a slab of stone four feet long and ¾ inch thick may be readily cut with a saw in a vertical plane, but a ¾ inch piece cannot be cut in a horizontal plane without chipping or shattering.

There is a need for a new article of manufacture, consisting of a composite of stone or a somewhat flexible damping material that can be purchased by a cabinet-maker and simply inserted with an adhesive into a groove in wood formed by a suitable means, such as a router.

SUMMARY OF THE INVENTION

The present invention is a method of making inlays of hard material in small cross-sectional dimensions for insertion into softer material that would be damaged by the strenuous abrading materials used in polishing hard materials. A damping material is used to mount the hard material for processing steps of grinding and polishing in order to avoid chipping and breaking of the hard brittle material, especially in the dimensions on the order of two centimeters or less.

In particular, granite and marble inlays in wood provide a beautiful contrast in texture and colors that are desirable in the decorative arts. Furniture, storage cabinets, and virtually any wooden surface used in construction may be decorated with stone inlays at modest cost using the present invention.

In addition, the invention includes an article of manufacture consisting of a composite of stone and damping material having a precise configuration for insertion into a wood or other relatively soft substrate.

DESCRIPTION OF THE PREFERRED EMBODIMENTS

Figure 1:
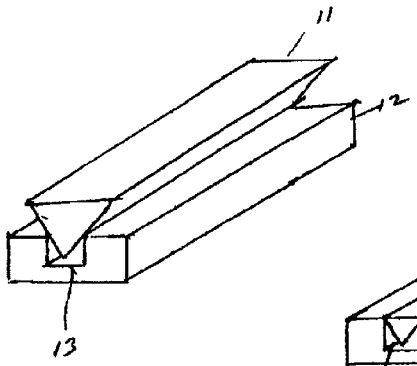
FIG. 1 is an isometric view of a raw stone resting on a mount before processing.

The method of the present invention may be used with any of a variety of hard, brittle materials, such as concretions of stone, like marble or granite, or vitreous materials that are hard and brittle, yet capable of being cut and polished in the form of inlays. Concretions made of Portland or magnesium oxychloride cement or the like are also contemplated as the hard materials. Here, I shall use the term "stone" to refer to all such hard, brittle materials, even though vitreous materials are not, strictly speaking, concretions.

The desired cross-sectional configuration of inlays is triangular with the point down or trapezoidal with the short dimension down and sloping sides. This permits sufficient flexible damping material to engage the sloped sides and support the relatively small inlay portion while the upper portion of the starting stone is ground away. Grinding takes advantage of the great compressive strength of the work piece. Slicing with a saw in a horizontal plane across a thin work piece would not be possible because of the poor tensile strength of stone.

The substrate may be any material that is substantially softer than stone, such that it would be damaged by the harsh abrasions used with hard materials to form highly polished surfaces desired in inlays. Thus, synthetic plastic materials, whether thermoplastic or thermosetting, may be used as substrates. By far the preferred substrate is wood, which can provide a huge variety of graining, color, and texture. The combination of stone and wood is aesthetically pleasing as decoration for any kind of construction, from buildings, interior and exterior, and interior decoration, even automobile interiors.

The mount on which the stone is mounted for processing as a composite may be any material that absorbs the grinding and polishing energy imparted to the hard material so that the brittle stone will not break or chip. Thermosetting resins are suitable materials.

One example of a mount is a filled resin sold under the trade name Surrell, by Formica Corp., Cincinnati, Ohio. It is believed to be about 40% polyester/acrylate resin filled with about 60% aluminum trihydrate. It is available in sheets that can be readily cut and routed to form a depression approximating the depression formed in the substrate into which the final stone inlay is to be processed. When stone is mounted in Surrell, the abrading of the sides of the inlay to reach the desired width of inlay easily abrades the Surrell as well as the stone.

Another mounting material is plywood having a sufficient number of layers to provide damping when used to support stone for polishing. I use half-inch plywood and use the same router that makes the depression in the substrate, so that the dimensions of the trough in the mount is exactly the same as those of the substrate. Also, plywood is dimensionally stable, even when wet. Any exterior grade plywood is suitable, preferably at least ⅜ inch thick.

My preferred mounting material is ultra high molecular weight polyethylene that can serve as a mold for the inlay. I prefer a product named UHMW Polyethylene from Precision Plastics, Sacramento, Calif. It is dimensionally stable and can be precisely formed to accommodate any shape of inlay. For example, inlays of granite up to five feet long, and ⅜ inch wide, can be prepared in such a mold by the present invention. A further advantage of the polyethylene mold is that its smooth surface does not adhere to the resin, such as epoxy, on which the granite is mounted. The formed inlay may readily be extracted from the polyethylene mold using simple tools. The mold may be reused many times, even when polishing abrasives for the stone remove some of the top surface of the mold. The great advantage over Surrell and wood is that the molds of ultra high molecular weight polyethylene need not be cut for each inlay and may be reused many times. The composite of stone and epoxy is simply removed from the polyethylene mold, with no grinding or abrasion of the mold, as is the case with Surrell or wood.

Whatever damping material is used for mounting the stone for polishing, the stone is inserted into the trough filled with sufficient damping material to absorb the energy applied to the stone by abrasion. A composite of stone and damping material is formed in the trough of the mount. The composite and mount are then abraded to make a smooth surface on the exposed face of the inlay. The final polishing of stone is with a diamond pad of extremely fine particles, such as 3500 grit. I have found that a plywood mount "gives" or compresses more than a Surrell mount so that the extremely fine final polish does not abrade plywood, though it can abrade Surrell. Surrell is a good mount for heavy abrading; plywood is a good mount for extremely fine polishing. Plywood occasionally has gaps or voids between plies, which can drain off adhesive, leaving a gap between stone and mount. Surrell has no gaps or voids. Polyethylene is superior for all purposes.

Because it is desired to secure the inlay to the damping material so that the stone will not fall out when the finished composite of inlay and damping material is inverted, I prefer to use an adhesive to serve as both the securing means and as a damping means. The preferred adhesive/damping material is epoxy resin, a widely available adhesive. Epoxy is dimensionally stable, unlike many adhesives that shrink. The epoxy resin flows before it is cured, so I prefer to make a trough in a mount of either Surrell or plywood that is exactly the shape of the finished inlay. My preferred epoxy resin is one that has a viscosity like honey, though it may be filled. It is epoxy called West System from Gougeon Brothers, Inc., Bay City, Mich. I then pour epoxy resin into the trough in a sufficient amount to adhesively secure the stone without any voids or bubbles. The stone to be finished is inserted into the trough of the mount before the epoxy resin cures and then the resin is cured, forming a composite of stone/epoxy/mount. The composite is then abraded on the exposed surface and on the sides to any shape desired and the bottom of the three-part composite is abraded to allow the finished product to lie flush in the depression formed in the substrate. Because the abrading of the bottom of the composite follows the grinding and polishing of the exposed surface of the stone, it is possible that all of the Surrell or plywood is removed, leaving only stone and epoxy as the composite to be inserted into the substrate.

As noted above, when polyethylene models are used, there is no need to grind or polish to remove all of the mount, as in the case of Surrell or plywood.

The greater the depth of supporting epoxy, the more flexible the stone/epoxy composite is, that is, the thickness of the stone in relation to the thickness of the damping material should be in a ratio of at least 1:2 to minimize the risk of breaking or chipping the stone. A five foot by ⅜ inch cut of granite would break of its own weight if supported at midpoint, with a damping material of epoxy below, the strip flexes and does not break.

In my prior application describing mounts of Sorrell and plywood, I described the formation of beveled sides of the stone/epoxy composite. When ultra high molecular weight polyethylene is used, the bevel to permit release from the mold and insertion into the substrate can be formed right in the mold. This avoids the need to bevel the sides of the article of manufacture. A 5 degree slope inwardly is preferred, although the range is 1 to 10 degrees. That is, the dimension across the top of the stone should be about 1/16 inch greater than the dimension at the bottom of the stone/epoxy composite.

The finished article of manufacture can be sold to cabinet makers, floor installers and carpenters, who cut a precise trough into the substrate, insert an adhesive, such as epoxy, and drop in the stone/epoxy composite. This avoids on-site preparation, polishing or finishing involving multiple tradesmen.

The stone for the inlay is cut from a larger piece of stock to dimensions larger than the dimensions of the inlay in the final product. I have found that the shortest dimension should not be less that a centimeter or two, depending on the type of stone, or else the material will crack, break or chip when being separated from the larger stock. When the stone is mounted to form a stone/damping material composite, then smaller dimensions of stone may be accommodated.

Figure 2:
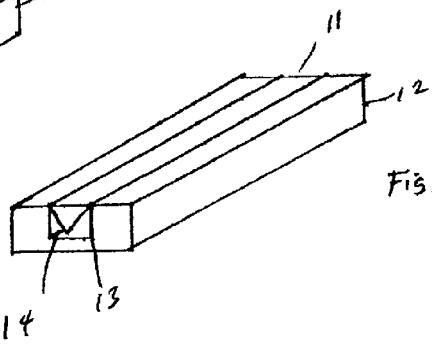
FIG. 2 is an isometric view of a composite of stone and damping material in a mount.

FIG. 1 shows the raw stone 11 mounted on mount 12. Mount 12 has a trough 13 cut into it to hold stone 11. Stone 11 has a generally V-shaped bottom to rest in a substantial amount of damping material flowed into through 13. Stone 11 is placed on mount 12 so that when cut to be flush with the surface of the mount the widest dimension of the stock as mounted is the hypotenuse of a triangle flush with the surface of the mount material as shown in FIG. 2. In that way, the hypotenuse is longer than the width of the final inlay, allowing for a reduction in size to the final dimension.

Typically, the starting material is a slab ¾ inch thick. A work piece about one inch wide is cut from the slab and cut to provide sloped sides extending downwardly. The usual depth of an inlay is approximately ⅜ inch, which means that ⅜ inch of stone above the mount 12 must be abraded away to form an inlay 11 flush on top with the top surface 12 of the mount or mold.

The reason for mounting the raw stone with one side of the triangle formed parallel with the surface of the mount or mold (as shown in FIG. 2) is to allow the stone to be clamped to the mount while the epoxy sets. The more the epoxy that supports the stone, the safer is the grinding operation to reach the final dimensions of the stone inlay. Also, a substantial backing of damping material allows a relatively thin stone to be processed without breaking.

FIG. 2 shows the composite of stone 11 in damping material 14 that is placed in trough 13. The damping material is softer than the stone, so stone-abrading techniques are not needed to remove the excess. The generally V-shape cross section of the bottom of the stone permits maximum damping. The damping material 14 may conveniently be epoxy resin in an amount greater than the amount of stone 11 in the composite.

Figure 3:
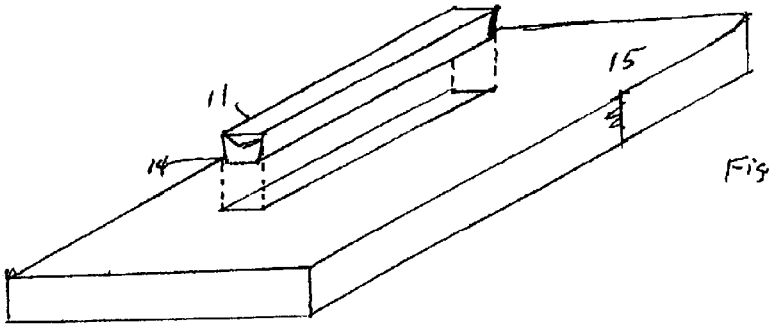
FIG. 3 is an isometric view of an inlay composite ready to be inserted into the substrate.

Stone 11 is formed in the desired dimensions in the Y-axis in a mold in FIG. 2. The slight reduction in the horizontal X-axis is safely accomplished by reason of the large amount of damping material supporting the edges. More than half of the stone 11 in FIG. 1 is abraded away to form a flat, polished surface as shown in FIG. 2. The mount is then removed to leave a slightly beveled composite of stone 11 and damping material 14 ready to be inserted into substrate 15 as shown in FIG. 3. A slight slope downwardly and inwardly in the composite of stone 11 in damping material 14 serves to allow a tight adhesive seal between the composite 11 and 14 and substrate 15. The slope should be 1° to 100° from vertical, with the optimum being 5° from vertical.

FIG. 3 shows the final composite ready to be inserted into substrate 15. The substrate 15 is highly polished and finished as desired. The inlay 11 is flush with the surface of substrate 15 and has a high polish as well. The two polished surfaces could not have been formed in situ, because of the differential in hardness. The embedded inlay 11 has a generally V-shaped cross-section as shown in FIGS. 2 and 3. It is secured to the substrate 13 by any suitable means, such as epoxy resin.

Figure 4:
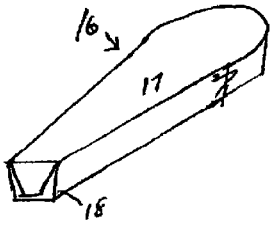
FIG. 4 is an isometric view of a curvilinear inlay mounted on damping material and cut to the desired dimensions.

Any shape of inlay may be formed using the present invention. For example, a curvilinear inlay in the shape of a flower petal is shown in FIG. 4. Petal 16 consists of a stone surface 17 mounted on a damping material 18. The damping material is thicker at the edges to provide maximum support during the abrading of the edges to reach the precise fit for the depression formed in the substrate (not shown). The composite of stone 17 and damping material 18 of FIG. 4 has been polished on the exposed surface and cut to the precise size needed to fit into the substrate. Again, a slight slope is provided on the sides of the composite.

The slope along the edges of stone 17 allows a greater amount of supporting damping material 17 to prevent breaking or chipping of the edges during abrasion to reduce the size of the piece 16 to the desired dimensions. A lesser amount of damping material is placed under the bottom of stone 17. Again, if the smallest dimension of stone 17 is under 2 centimeters, the amount of supporting damping material 18 should be greater to allow flexibility of the composite of stone 17 and damping material 18. The sloped sides of stone 17 in FIG. 4 are required only if the cross-sectional width of piece 14 is about two centimeters or less. If piece 14 is larger, then straight sides may be used.

Figure 5:
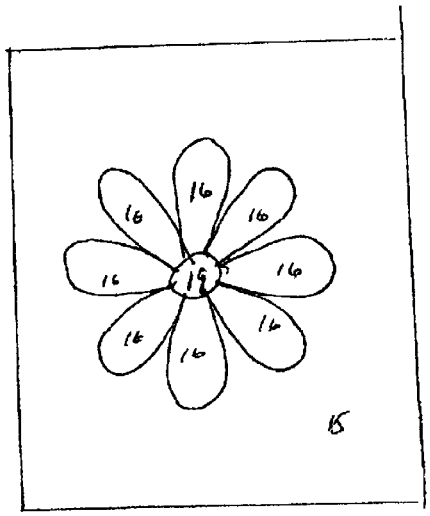
FIG. 5 is a plan view of the completed inlay with multiple curvilinear elements as in FIG. 4.
Figure 1:
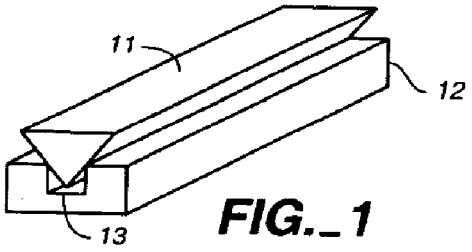
Figure 2:
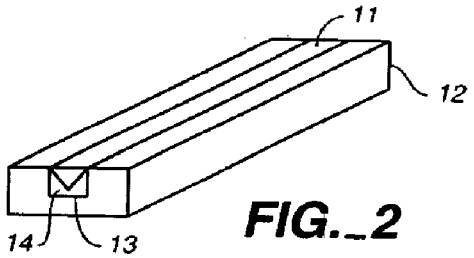
Figure 3:
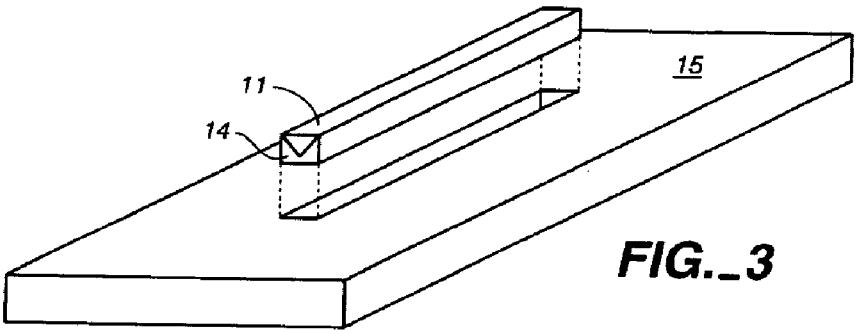
Figure 4:
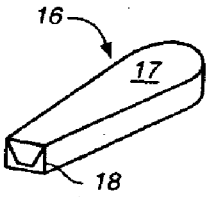
Figure 5:
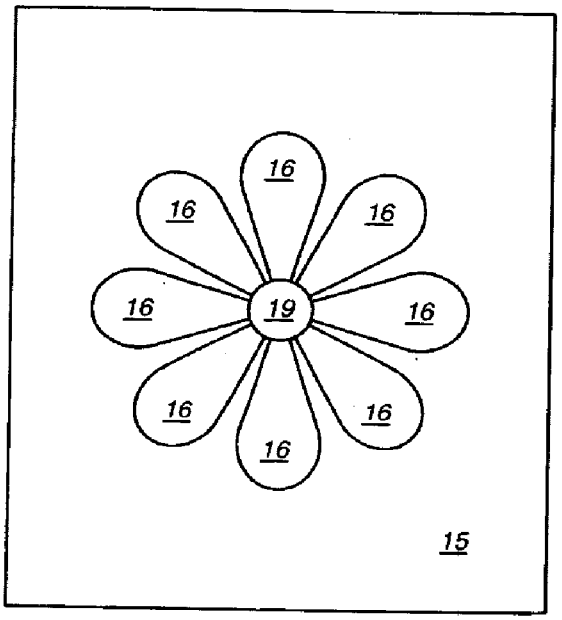

FIG. 5 is a top view of the finished product containing a flower made of multiple curvilinear elements 16 like those of FIG. 4 arrayed around a center stone piece 19. Obviously, any degree of complexity in design may be accommodated. However, each piece should be shaped with a sloping side to give maximum support of damping material under a minimum depth of stone during the step of reducing the dimensions of the stone to fit in the depression formed in the substrate 15. Also, the sides of composites of stone and damping material should also be slightly sloped to insure that gaps do not form between stone 17 and substrate 15.

It will be apparent to one skilled in the art that any hard, brittle material may be shaped and polished into a precisely dimensioned inlay apart from the substrate into which it is to be inserted, so that polishing of the hard material will not damage the substrate as it would if performed in situ.

What is claimed is:

1. A method of making a decorative article by inlaying stone into a depression formed in a substrate comprising (1) forming a depression in the substrate having the desired depth, width and breadth for the finished stone inlay; (2) cutting a work piece from a stone source with dimensions greater than the dimensions of the depression in the substrate; (3) mounting the work piece in a mold having dimensions the same as the depression containing damping resin to absorb energy of abrading the stone work piece without damaging the stone; (4) reducing the breadth and width dimensions of the surface of the stone to match those of the depression to allow the stone inlay to lie flat in the depression; (5) removing the stone encased in damping resin from the mold; (6) polishing the stone surface to the desired finish; and (6) inserting the stone encased on its sides and bottom into the depression.

2. A method as in claim 1 wherein the substrate is wood.

3. A method as in claim 1 wherein the stone is granite.

4. A method as in claim 1 wherein the stone is marble.

5. A method as in claim 1 wherein the stone is vitreous.

6. A method as in claim 1 wherein the damping resin is epoxy resin.

7. An article of manufacture comprising a stone inlay having sloped sides downwardly and inwardly from a polished surface with supporting damping material adhered to all surfaces of the stone inlay except the polished surface, the stone inlay and adhered damping material being inserted into a depression formed in a substrate having surface edges that match the surface edges of the stone inlay to provide a smooth surfaced decorative article.

8. An article of manufacture as in claim 7 wherein the damping material is epoxy resin.

9. An article as in claim 7 wherein the sloped sides of the stone inlay deviate from vertical by 1 to 10 degrees.

10. An article as in claim 7 wherein the substrate is wood.

11. An article as in claim 7 wherein the stone is granite.

12. An article as in claim 7 wherein the stone is marble.

* * * * *

UNITED STATES PATENT AND TRADEMARK OFFICE

CERTIFICATE OF CORRECTION

PATENT NO. : 6,772,748 B2
DATED : August 10, 2004
INVENTOR(S) : Cleary

It is certified that error appears in the above-identified patent and that said Letters Patent is hereby corrected as shown below:

Title page illustrating a drawing figure should be deleted, and substitute therefor a title page illustrating a figure as shown on the attached sheet.

Delete drawing figures 1-5 on sheet 1 of 1, and substitute therefore drawing figures 1-5. (Attached)

Column 5,
Line 8, insert -- 12 -- after the word "mold".

Signed and Sealed this

Seventh Day of December, 2004

JON W. DUDAS
*Director of the United States Patent and Trademark Office*

(12) United States Patent
Cleary

(10) Patent No.: US 6,772,748 B2
(45) Date of Patent: Aug. 10, 2004

(54) METHOD OF FORMING STONE INLAYS IN WOOD AND ARTICLE OF MANUFACTURE

(76) Inventor: Sean Cleary, 336-B Berkshire Ave., Redwood City, CA (US) 94063

( * ) Notice: Subject to any disclaimer, the term of this patent is extended or adjusted under 35 U.S.C. 154(b) by 0 days.

(21) Appl. No.: 10/234,792

(22) Filed: Sep. 5, 2002

(65) Prior Publication Data

US 2003/0070671 A1 Apr. 17, 2003

Related U.S. Application Data

(63) Continuation-in-part of application No. 09/975,207, filed on Oct. 12, 2001.

(51) Int. Cl.[7] ..... B28D 1/00

(52) U.S. Cl. ..... 125/1; 125/30.01; 125/35; 451/28; 451/29; 451/30; 451/31; 451/41; 451/44

(58) Field of Search ..... 125/1, 30.01, 35; 451/28, 29, 30, 31, 41, 44

(56) References Cited

U.S. PATENT DOCUMENTS 3,842,488 A * 10/1974 Mitchell ..... 29/527.6
6,499,314 B1 * 12/2002 Weimann et al. ..... 63/26
6,617,005 B2 * 9/2003 Duffney ..... 428/138

* cited by examiner

*Primary Examiner*—Joseph J. Hail, III
*Assistant Examiner*—Shantese McDonald
(74) *Attorney, Agent, or Firm*—John P. Sutton

(57) ABSTRACT

A method of forming a stone inlay in an abrasion-sensitive substrate, such as wood, by forming a depression in the substrate, mounting stone on a damping material capable of absorbing the abrasive energy applied to the stone in reducing the dimensions of the stone to fit the depression, cutting the inlay to size and inserting it into the substrate. The cut inlay/damping material composite may be sold separately as an article of manufacture.

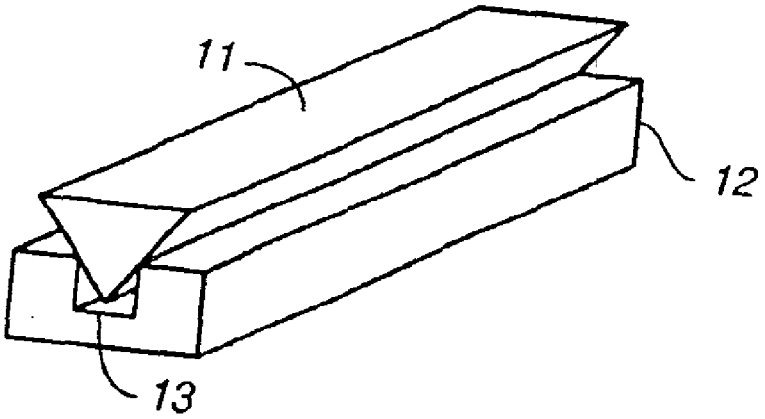

12 Claims, 1 Drawing Sheet